US005830091A

United States Patent [19]

Romanick

[11] Patent Number: 5,830,091

[45] Date of Patent: Nov. 3, 1998

[54] SPORTS BALL THROWING TRAINING DEVICE

[76] Inventor: Ron Romanick, 16028 E. Sunflower Dr., Fountain Hill, Ariz. 85268

[21] Appl. No.: 974,082

[22] Filed: Nov. 19, 1997

[51] Int. Cl.[6] ..... A63B 37/14

[52] U.S. Cl. ..... 473/596; 473/451

[58] Field of Search ..... 473/496, 234, 473/614, 233, 596, 597, 575, 576, 475; 273/186 A

[56] References Cited

U.S. PATENT DOCUMENTS

| | | | |
|---|---|---|---|
| 3,202,424 | 8/1965 | Patterson | 473/596 |
| 3,498,616 | 3/1970 | Hurst . | |
| 4,286,783 | 9/1981 | Newcomb | 473/451 |
| 4,309,038 | 1/1982 | Spoon | 473/596 |
| 4,592,545 | 6/1986 | Sagedahl et al. . | |
| 5,000,449 | 3/1991 | Weeks . | |
| 5,058,885 | 10/1991 | Brant | 473/596 |
| 5,228,690 | 7/1993 | Rudell et al. . | |
| 5,290,041 | 3/1994 | Kettelson | 473/596 |
| 5,348,292 | 9/1994 | Norman, Sr. . | |
| 5,542,660 | 8/1996 | Cione | 473/596 |
| 5,634,856 | 6/1997 | Rainey . | |
| 5,649,875 | 7/1997 | Spector | 473/596 |
| 5,735,776 | 4/1998 | Swezey | 473/596 |

*Primary Examiner*—Theatrice Brown
*Attorney, Agent, or Firm*—Snell & Wilmer L.L.P.

[57] ABSTRACT

The present invention includes a training aid for providing an audible indication of a properly thrown sports ball. The device includes an elongated hollow, tubular member with closed ends and an inner dowel which is freely moveable longitudinally within the hollow tube. The ends of the tubes can alternatively include plugs, weights, magnets, or bolts, thereby allowing the device to be adjusted or changed for varying levels of sound, weight, resistance, release points or other training needs. One end of the tubular member includes an upwardly curving handle replicating the lower end of a sports ball, and an upper curved handle is located at a predetermined distance from the lower handle, replicating the top of the sports ball. The upper curved handle is preferably adjustable along the length of the tubular member, thereby allowing with the same device, the distance between the handles to be increased or decreased to replicate various sized sports balls, namely a baseball, softball, football, and/or the like. Alternatively, one end of the tubular member can be inserted into a replicated or actual sports ball (or attached to the outside of a sports ball) so the athlete is able to grasp the sports ball with his or her proper grip.

6 Claims, 4 Drawing Sheets

FIG. 2

SPORTS BALL THROWING TRAINING DEVICE

FIELD OF THE INVENTION

The present invention relates, generally, to a sports ball throwing training device, and more particularly, to a method and apparatus for audibly indicating proper throwing mechanics.

BACKGROUND OF THE INVENTION

The sporting industry is a multi-billion dollar industry with participants of all skill levels. With the continued expansion of the sporting industry, competition among athletes has intensified. Thus, the need to become a better athlete is usually imperative for being drafted onto a sports team, winning competitive events, and improving personal goals. To become a better athlete, a participant typically practices to fine-tune every aspect of his or her sporting experience, namely improving form, mechanics, strength, speed and accuracy.

When a person throws a sports ball, such as a baseball, softball, football and/or the like, the person typically uses a circular arm motion whereby the arm is stretched backwards, then over the shoulder, and finally a strong, accelerated forward circular motion followed by the athlete releasing the ball with a strong snapping of the wrist. Alternatively, in other sports such as softball, a circular arm motion occurs, but in the underhand direction. In any related sport, the proper positioning of the arm and wrist is usually a major factor in delivering a more powerful, more controlled, and more accurate throw. Aside from physical conditioning and strength, the techniques used to throw a ball, including the precise rotation for release of the ball is a difficult skill which many athletes require many hours of training to perfect. Thus, a simplified device is needed as a training aid for instructing athletes on the proper throwing technique which teaches muscle memory that leads to an improved arm circle and maximum power, control, speed and accuracy.

An athlete could practice the proper throwing motion by throwing a sports ball, such as a baseball, repeatedly until improved technique is achieved. However, the repeated throwing of a baseball typically causes muscles to tire and other more severe medical problems over time. Additionally, an injured athlete or handicapped individual may not be able to properly throw a baseball. Moreover, the throwing of baseballs for practice requires retrieval and a large outdoor field in which to practice. Furthermore, many devices exist for training athletes on the proper throwing technique; however, the devices are typically only applicable to one sport or one type of sports ball. Other devices exist for the training of the proper swinging technique for golf or baseball swings, but these devices are limited to the training of an optimum swing and the training of the optimum point for impact against the ball. Thus, a training aid is needed for improving throwing technique in an indoor or outdoor location without substantially increasing the potential for medical injury from repeated use.

SUMMARY OF THE INVENTION

The present invention includes a training aid for providing an audible indication of a properly thrown sports ball. The device includes an elongated hollow, tubular member with closed ends and an inner dowel which is freely moveable longitudinally within the hollow tube. The ends of the tubes can alternatively include plugs, weights, magnets, or bolts, thereby allowing the device to be adjusted or changed for varying levels of sound, weight, resistance, release points or other training needs. One end of the tubular member includes an upwardly curving handle replicating the lower end of a sports ball, and an upper curved handle is located at a predetermined distance from the lower handle, replicating the top of the sports ball. The upper curved handle is preferably adjustable along the length of the tubular member, thereby allowing with the same device, the distance between the handles to be increased or decreased to replicate various sized sports balls, namely a baseball, softball, football, and/or the like. Alternatively, one end of the tubular member can be inserted into a replicated or actual sports ball (or attached to the outside of a sports ball) so the athlete is able to grasp the sports ball with his or her proper grip.

When in use, the athlete grabs the lower end of the tubular member, either around the curved handles or around the replicated or actual sports ball, and proceeds to rotate his or her arm in a circular motion, thereby replicating a throwing motion. During the rotation of the arm, the inner dowel remains substantially stationary at one end of the tubular member, thereby indicating the proper throwing technique. When a predetermined point is reached during the throwing motion, the athlete will snap his or her wrist to replicate the optimum release point. When the wrist is snapped, the centrifugal force acts upon the inner dowel, thus forcing the ball to travel longitudinally within the hollow tubular member, and eventually impacting the outside end of the tubular member, resulting in an audible indication of the changed wrist location. During an incorrect throwing technique, the inner dowel will not move at all or will impact the end of the tubular member at an earlier point, giving the athlete an audible signal to make the athlete aware of an inaccurate throw.

BRIEF DESCRIPTION OF DRAWING FIGURES

The present invention will now be described in connection with the appended drawing figures, wherein like numerals represent like elements, and:

DETAILED DESCRIPTION OF PREFERRED EXEMPLARY EMBODIMENTS

The present invention preferably includes a sports ball throwing training aid device which creates an audible warning during a practice throw (whereby the ball is not released), indicating a proper or improper wrist positioning depending on the phase of the throw when the audible indication occurs. With respect to FIG. 1, a cross-sectional view of the overall device in accordance with a preferred embodiment of the present invention is shown. This preferred embodiment includes, generally, a hollow tubular member 12 having an inner dowel 40 which travels longitudinally freely along the inside of hollow tubular member 12. One end of hollow tubular member 12 includes a means for gripping one end of tubular member 12 to replicate the gripping of a sports ball, namely, a baseball, softball, football, and/or the like. One of ordinary skill in the art will appreciate that the present invention can also be used for other non-sport activities which require similar movements.

Figure 1:
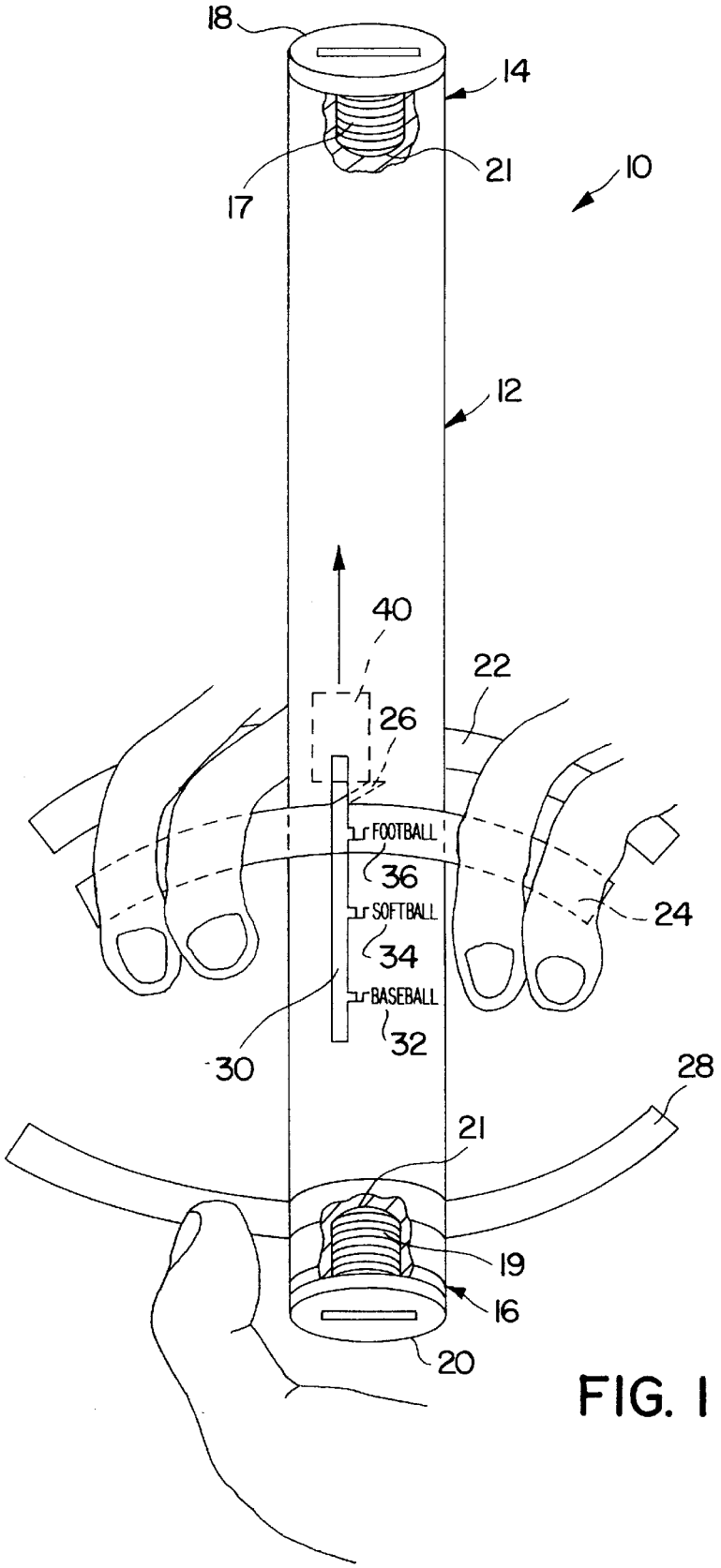
FIG. 1 shows a partial cut away view of a preferred embodiment in accordance with the present invention.

More particularly, with continued reference to FIG. 1, hollow tubular member 12 of throwing device 10 is preferably a metal tube of about 18 inches in length and about one inch in diameter. One of ordinary skill in the art will appreciate that tubular member 12 can be of any size, material or shape which can be incorporated into the present invention to yield substantially similar results. For example, tubular member 12 can be formed of a suitable plastic or metal alloy. Additionally, tubular member 12 can be filled with any liquid or other material which would alter the friction surrounding dowel 40.

Tubular member 12 preferably includes a first end 14 and a second end 16. Both ends 14, 16 preferably include weighted bolts 18, 20, respectively, in threaded engagement with ends 14, 16. In alternative embodiments, ends 14, 16 include any suitable device for closing off the hollow tubular member at one or both its ends, 14, 16. For example, tubular member 12 can be fabricated with permanently closed ends such as by soldering or the like, bolts of different weights, materials and sizes inserted into both ends, magnets inserted into both ends and/or the like. In a further alternative embodiment, bolts 18, 20 include a hard rubber material 21 coated on the inner end of bolts 18, 20 to suitably provide for shock absorption upon impact by inner dowel 40. In a preferred embodiment, a threaded engagement 17, 19 is used, thereby allowing for bolts 18, 20 to be easily removed and changed with bolts having different features including decreased or increased weight, magnetism and/or the like. In practice, an experienced trainer will typically adjust the weight of one or both bolts 18, 20 to assist in muscle development or for rehabilitation purposes.

A small dowel 40 is preferably located within hollow tubular member 12 such that dowel 40 freely moves longitudinally along the inside cavity within tubular member 12. Dowel 40 is preferably a solid metal element, but one of ordinary skill in the art will appreciate that dowel 40 can be an element of any size or shape which is capable of traveling longitudinally within tubular member 12. For example, dowel 40 can be a spherical ball. One of ordinary skill in the art will also appreciate that dowel 40 can be any suitable material, including metal, metal allow, plastic, magnetized material, and/or the like.

With continued reference to FIG. 1, second end 16 of tubular member 12 preferably includes a means for replicating a sports ball. In a preferred embodiment, an upwardly curving metallic handle 28 is suitably attached to end 16. Handle 28 preferably provides a lower gripping point for the thumb when device 10 is in use. One of ordinary skill in the art will appreciate that handle 28 can be of any suitable curvature, shape, material and/or the like. For example, handle 28 can be a circular plate attached to end 16 of tubular member 12. In an alternative embodiment, handle 28 includes a circular ring 29 which is suitably reciprocally received around end 16 such that handle 28 can be suitably slid along tubular member 12 and be located at any position along tubular member 12. Circular ring 29 alternatively includes a threaded inner surface such that handle 23 can be simply rotated (similar to a known wing nut) to adjust the distance between handle 28 and upper handle 22,24. Adjustable handle 28 allows device 10 to be adaptable to different hand sizes and comfort levels.

In a preferred embodiment, upper curved dual handles 22,24 are located at a predetermined distance from end 16, thereby providing support for the fingers when gripping device 10 during a throwing motion. Upper handles 22,24 are preferably located on opposite sides of tubular member 12 and connected by a perpendicular element 26, thereby forming an "H" type configuration. Perpendicular member 26 connects handles 22, 24 by being located within narrow, rectangular openings 30 which are aligned, but located on opposite sides of tubular member 12. The sides of rectangular openings 30 include indicia 32,34,36 indicating predetermined distances for fixing upper handles 22, 24 away from lower handle 28. The predetermined distances, 32, 34, 36 replicate the diameters of a baseball, softball, and football, respectively. One of ordinary skill in the art will appreciate that the diameter of any size ball can be replicated with the present configuration of handles 22,24 and 28. Upper handles 22, 24 are preferably temporarily fixed at the predetermined locations 32, 34, 36 by any suitable means for temporarily latching handles 22, 24 to tubular member 12. In a preferred embodiment, a notch is located at each distance, 32, 34, 36 and perpendicular cross member 26 simply fits within the selected notch. In an alternative embodiment (not shown), upper handles 22, 24 are replaced by a single handle fixedly attached to a predetermined point on handle 12. In this embodiment, the adjustability of lower handle 28 (as described above) preferably serves as the means for adjusting the distance between the handles. In another alternative embodiment (not shown), upper handles 22, 24 are replaced by a handle having a circular ring (similar to handle 28 described above) which is suitably reciprocally received around tubular member 12 such that the handle can be suitably slid along tubular member 12 and be located at any position along tubular member 12. Circular ring alternatively includes a threaded inner surface such that handle 23 can be simply rotated (similar to a known wing nut) to adjust the distance between handle 28 and upper handle 22,24.

Figure 2:
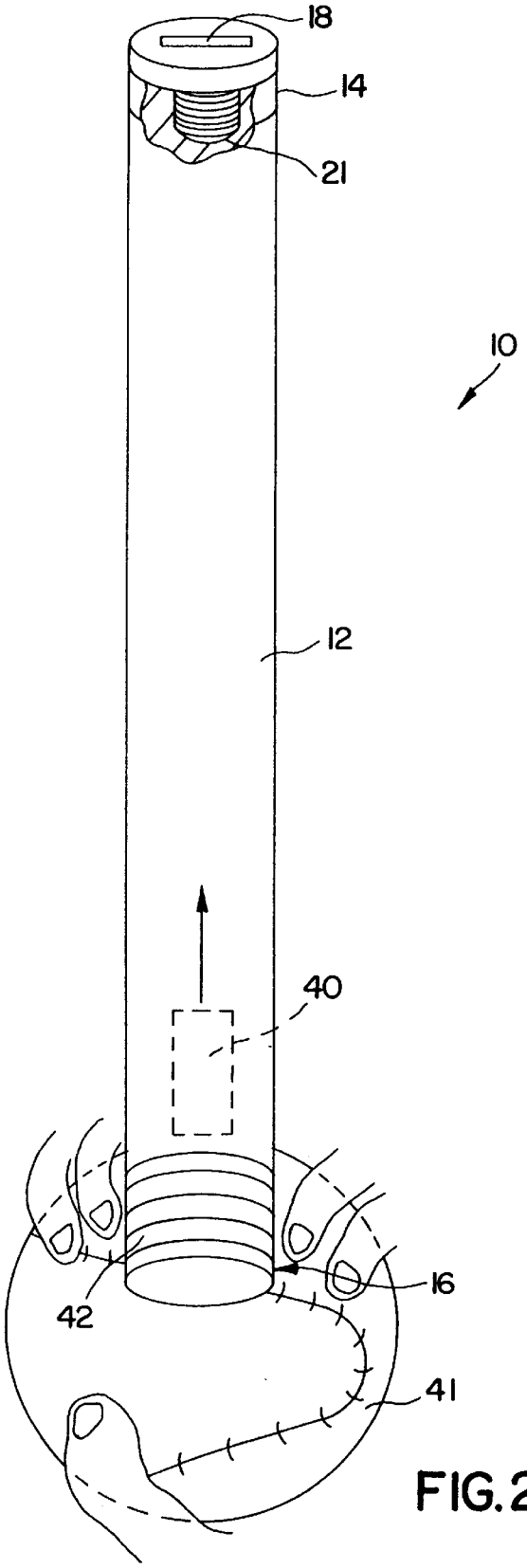
FIG. 2 shows an overall view of an alternative embodiment in accordance with the present invention.

With reference to FIG. 2, in an alternative embodiment, one or both of upper handles 22, 24 and lower handle 28 are eliminated and an actual sports ball 41, or replica of a sports ball, is fixedly attached to end 16 of tubular member 12. In a preferred embodiment, end 16 of tubular member 12 is reciprocally received within the sports ball. End 16 preferably includes a threaded outer surface capable of threadedly receiving a ball 41. Ball 41 preferably includes a bored out hole 42 having a threaded inner surface. Threaded end 16 allows for various replicated sports balls 41 (football, softball, etc.) having a bored out opening 42 to be easily temporarily connected to end 16 thereby increasing the versatility of device 10.

In use, with reference to FIG. 1, the athlete sets upper handles 22 and 24 at a predetermined height for replicating the type of sports ball which the athlete wishes to practice with. For example, an athlete wishing to practice a baseball throw would set upper handles 22, 24 within the notch located at the indicator 32. Cross member 26 would preferably restrict the lower travel of the inner dowel 40 such that the initial location of inner dowel 40 would be parallel with the upper surface of the hand. The athlete would preferably grasp upper handles 22, 24 with four fingers while locating tubular member 12 between any two fingers. The thumb of the athlete would wrap around lower handle 28.

Figure 3:
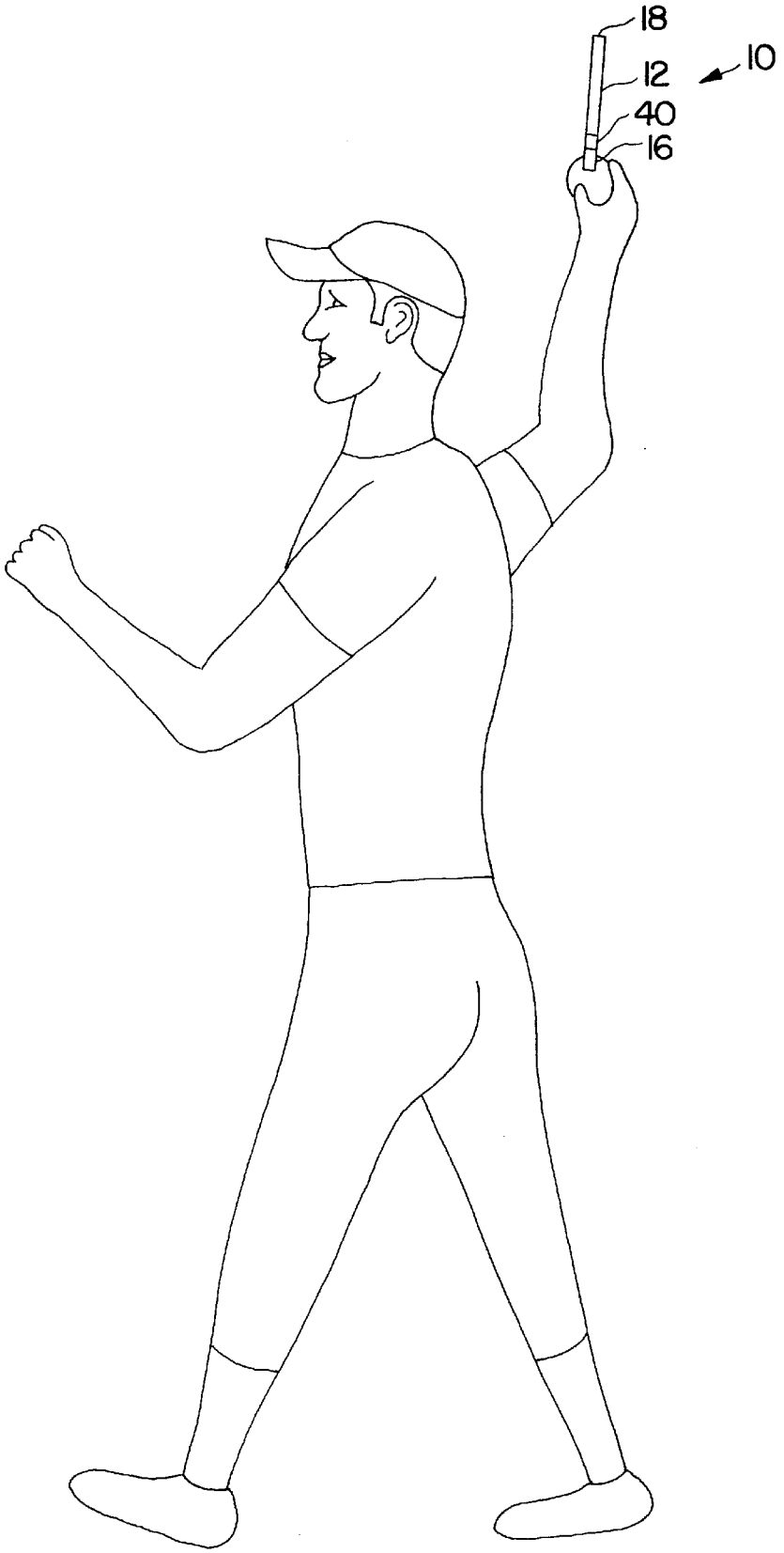
FIG. 3 shows the present invention in use during the beginning of a throwing motion in accordance with the present invention.
Figure 4:
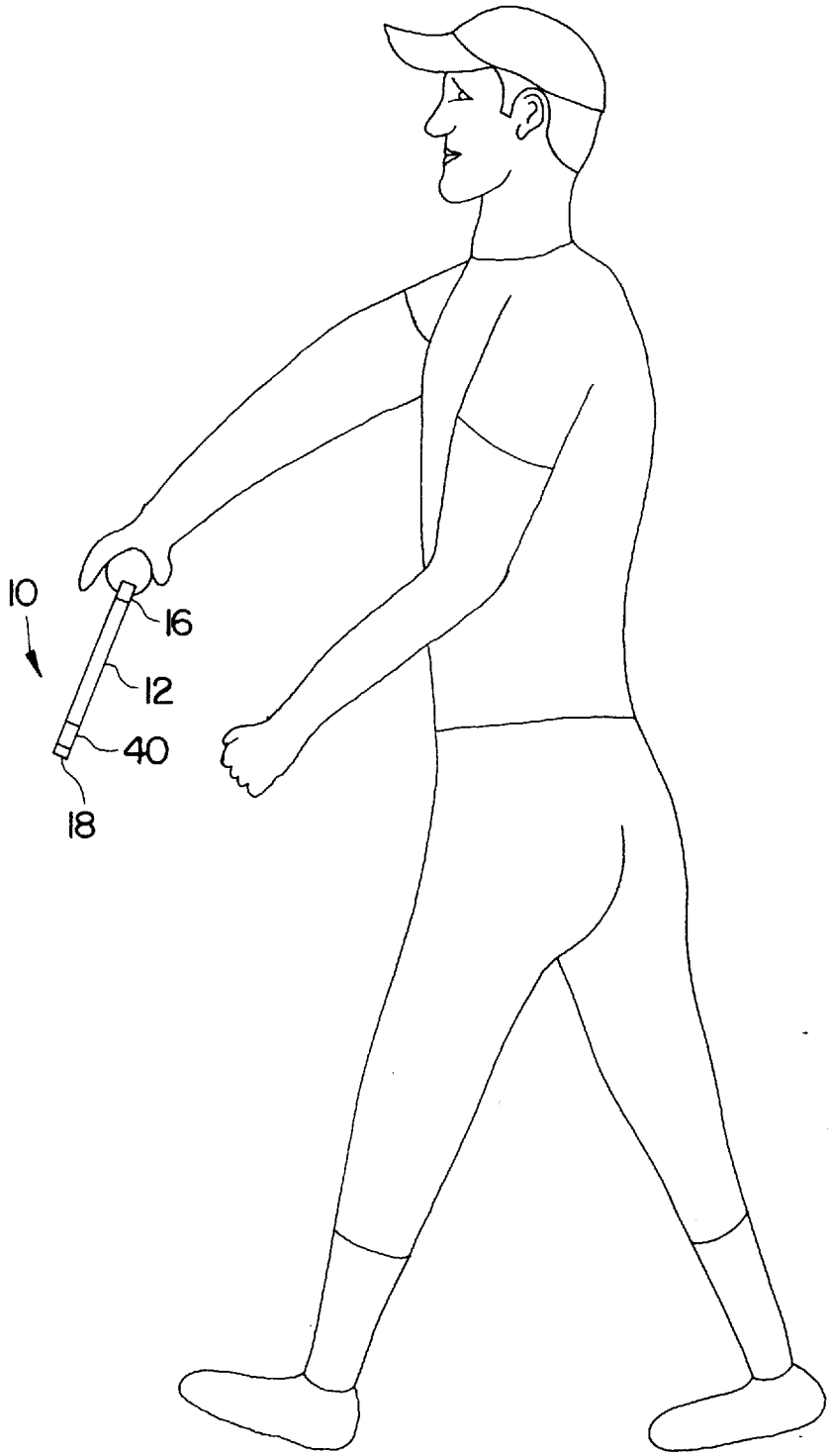
FIG. 4 shows a preferred embodiment of the present invention in use toward the end of a throwing motion in accordance with the present invention.

With reference to FIG. 3 and 4, the athlete would then perform a practice throwing motion by circularly rotating the arm backwards (FIG. 3), then over the head and then forwards in a circular motion (FIG. 4). Alternatively, the softball pitcher would preform a similar motion but in the underhand direction. At the point of replicated ball release (the ball is not released from the athlete's hand), the athlete's wrist snaps downward (or upward in softball), thus causing a centrifugal force to send inner dowel 40 traveling within tubular member 12 toward first end 14 (as best seen in FIG. 4). After inner dowel 40 hits first end 14, inner dowel 40 preferably makes an audible signal indicative of a proper throwing technique. In an alternative embodiment, by incorporating weighted plugs at either ends 14, 16 or by incorporating magnetic inner dowel 40, the effect of the centrifugal force on inner dowel 40 will be either increased or decreased, thus allowing the athlete to control the point at which inner dowel 40 contacts end 14 of tubular member 12.

While the present invention has been described in conjunction with preferred and alternative embodiments set forth in the drawing figures and the specification, it will be appreciated that the invention is not so limited. For example, other sizes, shapes, materials and components can be incorporated into the device. Various modifications in the selection and arrangement of components and materials may be made without departing from the spirit and scope of the invention as set forth in the appended claims.

I claim:

1. A training device configured to provide an audible indication of the accuracy of a throwing motion, said device comprising:

a hollow tubular member having a chamber, a first end and a second end;

a dowel disposed within said chamber of said tubular member, said dowel adapted for longitudinal movement within said chamber, as upon centrifugal force developed from a throwing motion;

a replicated sports ball attached at said second end of said tubular member.

2. The device of claim 1, wherein said first end of said tubular member includes a plug configured to close off said first end, said plug being temporarily attached to said first end, said plug being at least one of a bolt, magnet and rubber stopper.

3. The device of claim 1, wherein said second end of said tubular member includes a plug configured to close off said second end, said plug being temporarily attached to said second end, said plug being at least one of a bolt, magnet and rubber stopper.

4. The device of claim 1, wherein said replicated sports ball includes at least one of a baseball, softball and football.

5. The device of claim 1, wherein said replicated sports ball includes a bore configured to receive said second end of said tubular member.

6. The device of claim 1, wherein said replicated sports ball includes a first handle attached to said tubular member and a second handle attached to said tubular member, at least one of said first and second handles being adjustably attached to said tubular member.

* * * * *